US007263941B2

(12) United States Patent
Greghi

(10) Patent No.: US 7,263,941 B2
(45) Date of Patent: Sep. 4, 2007

(54) SAIL FURLING DEVICE

(76) Inventor: Renzo Greghi, Via Marostica, 31, I-20146 Milano (IT)

( * ) Notice: Subject to any disclaimer, the term of this patent is extended or adjusted under 35 U.S.C. 154(b) by 0 days.

(21) Appl. No.: 11/089,199

(22) Filed: Mar. 24, 2005

(65) Prior Publication Data

US 2005/0211149 A1 Sep. 29, 2005

(30) Foreign Application Priority Data

Mar. 25, 2004 (IT) ..... MI2004A0589

(51) Int. Cl.
*B63H 9/10* (2006.01)

(52) U.S. Cl. ..... 114/106

(58) Field of Classification Search ..... 114/104, 114/105, 106, 107
See application file for complete search history.

(56) References Cited

U.S. PATENT DOCUMENTS 4,248,281 A * 2/1981 Hood ..... 114/106
5,463,970 A * 11/1995 Hartlmeier et al. ..... 114/105
2002/0129754 A1* 9/2002 Greghi ..... 114/107

* cited by examiner

*Primary Examiner*—Sherman Basinger
(74) *Attorney, Agent, or Firm*—Hedman & Costigan P.C; James V. Costigan

(57) ABSTRACT

A sail furling/unfurling device comprises at least an outer foil wound about and made rigid with an inner foil or stay designed for transmitting the furling torque required for furling a sail being wound on a sheath profiled element, thereby the device allows to furl and unfurl large downwind foresails, i.e. asymmetrical spinnakers or the like, such as gennakers or MPS and can be easily used to hoist and lower the sails, in a simplified manner for a cruiser sailing with a short-hand crew.

7 Claims, 16 Drawing Sheets

SAIL FURLING DEVICE

BACKGROUND OF THE INVENTION

The present invention relates to a device for furling sails.

More specifically, the present invention relates to a device for furling large downwind foresails, such as asymmetric spinnakers or like type sails, such as gennakers or MPS.

As is known, a very important problem to be solved by cruisers sailing with a short-hand crew is that of maneuvering or handling large foresails, such as asymmetric spinnakers or other like sails, such as gennakers or MPS.

The most common solution adopted in the prior art, to facilitate sail hoisting and lowering operations on large downwind foresails provides to use a so-called "sock" or "sleeve" equipment, containing the sail in a furled or clamped condition.

Such an equipment conventionally comprises: a funnel element made of an ABS material rigid with the sock or sheath and coupled to an endless sheet and a head block.

The endless sheet is looped back to the head block, to drive the ABS funnel element from deck.

To said head block a strop is coupled, where the sail head and upper portion of the sock are affixed.

More specifically, said sock is hoisted to the mast head, and the sail bottom is connected to the swivel tack and latched to the manoeuvering foil or sheet.

The operation for inflating an asymmetric spinnaker provides to drive the endless sheet, to cause the funnel element to be hoisted to the mast head, thereby compacting the sock and freeing the sail.

For tightening the sail, the endless sheet is operated in a reverse direction, to cause the funnel element to be lowered to fully extend or spread the sail clamping sock.

Prior apparatus or equipments for performing the above mentioned operations, however, are affected by operating drawbacks which increase as the wind intensity or strength increases.

In fact, for performing the above mentioned operations, a crew member must move toward the bow of the boat, i.e. to a poorly protected and less safe position, to operate the endless sheets and downward drive the funnel element, for tightening the sail, or upward drive it for freeing said sail.

Moreover, the sheets must be in a well accessible exposed condition, i.e. they must not be twisted around the sail, inside the sock.

Actually, a locked endless sheet would render very dangerous the sail tightening or freeing operation, both due to an unstable equilibrium condition affecting the crew member, and a possible anomalous operation of the sail which, if it is not properly tensioned in its working position, can be suddenly deflated and inflated again.

Thus, a jamming of the endless sheets would be very dangerous and difficult to be eliminated, thereby forcing the boat crew to perform an emergency operation to recover the sail.

The prior art discloses further furling devices for furling or unfurling asymmetric sails.

All the above prior constructions, however, provide that the sail is designed and made to fit the features of the furling/unfurling system.

In actual practice very slim sails have been designed, such as drifters and reachers, which can be easily furled, for sailing rates with the tack forward to the beam.

The sails are herein furled around a foil and are rigid therewith, and accordingly being tensioned between tack and halyard.

However the above prior systems are specifically suitable for very high speed boats, catamarans, or very light and planing mono-hull boats, designed for sailing with the wind forward of the beam.

In no case the above mentioned systems are designed or suitable for furling downwind sails, asymmetric spinnakers of standard construction or like sails, such as gennakers or MPS.

SUMMARY OF THE INVENTION

Accordingly, the aim of the present invention is to provide such a device allowing to furl and unfurl or free downwind sails such as asymmetric spinnakers or the like, i.e. gennakers or MPS, of standard construction.

Within the scope of the above mentioned aim, a main object of the invention is to provide such a sail furling/unfurling device which can be used in a very simple manner, and allows to host and lower the sail in a very simplified manner for a cruiser or sailor sailing with a short-hand crew.

Another object of the invention is to provide a combination of a flexible furling/unfurling device and sail, of small volume and adapted to be easily stored.

Yet another object of the present invention is to provide such a device allowing to furl the sail on a sheath profiled element to which no furling torque is applied, thereby preventing said sail from being stretched or torn.

Yet another object of the present invention is to provide such a sail furling/unfurling device allowing the sail to be easily unfurled at the cockpit, i.e. the most protected and safe position onboard.

According to one aspect of the present invention, the above mentioned aim and objects, as well as yet other objects, which will become more apparent hereinafter, are achieved by a device for furling/unfurling sails, characterized in that said device comprises at least an outer foil wound about and made rigid with an inner foil or stay adapted to provide a sail furling torque to furl said sail on a sheath profiled element.

BRIEF DESCRIPTION OF THE DRAWINGS

Further characteristics and advantages of the present invention will become more apparent hereinafter from the following disclosure of a preferred, though not exclusive, embodiment of the invention, which is illustrated, by way of an indicative, but not limitative, example in the accompanying drawings, where.

DESCRIPTION OF THE PREFERRED EMBODIMENTS

Figure 5:
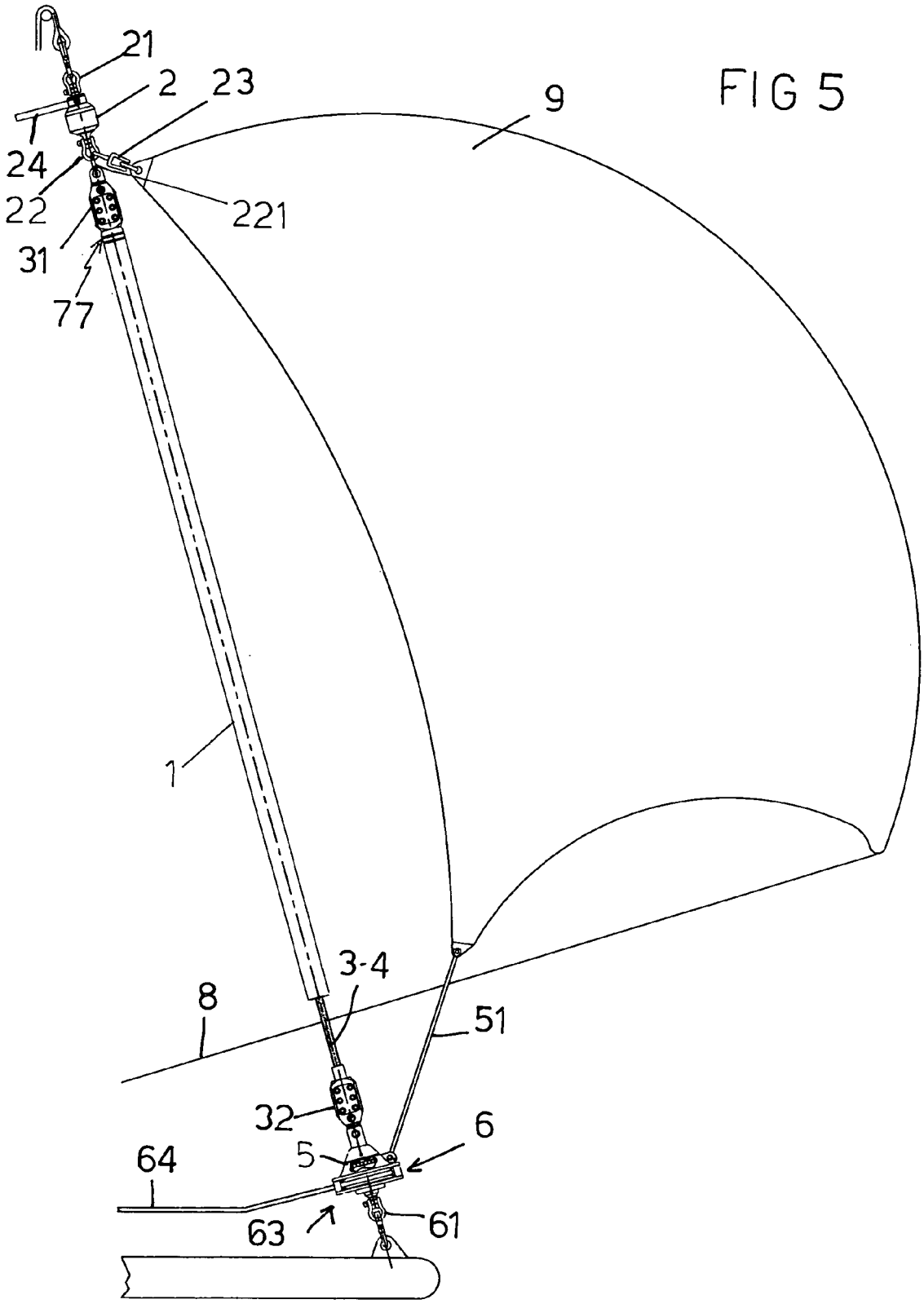
FIG. 5 is a schematic side elevation view of a further detail of the subject device, as applied to a sail on a boat.
Figure 6:
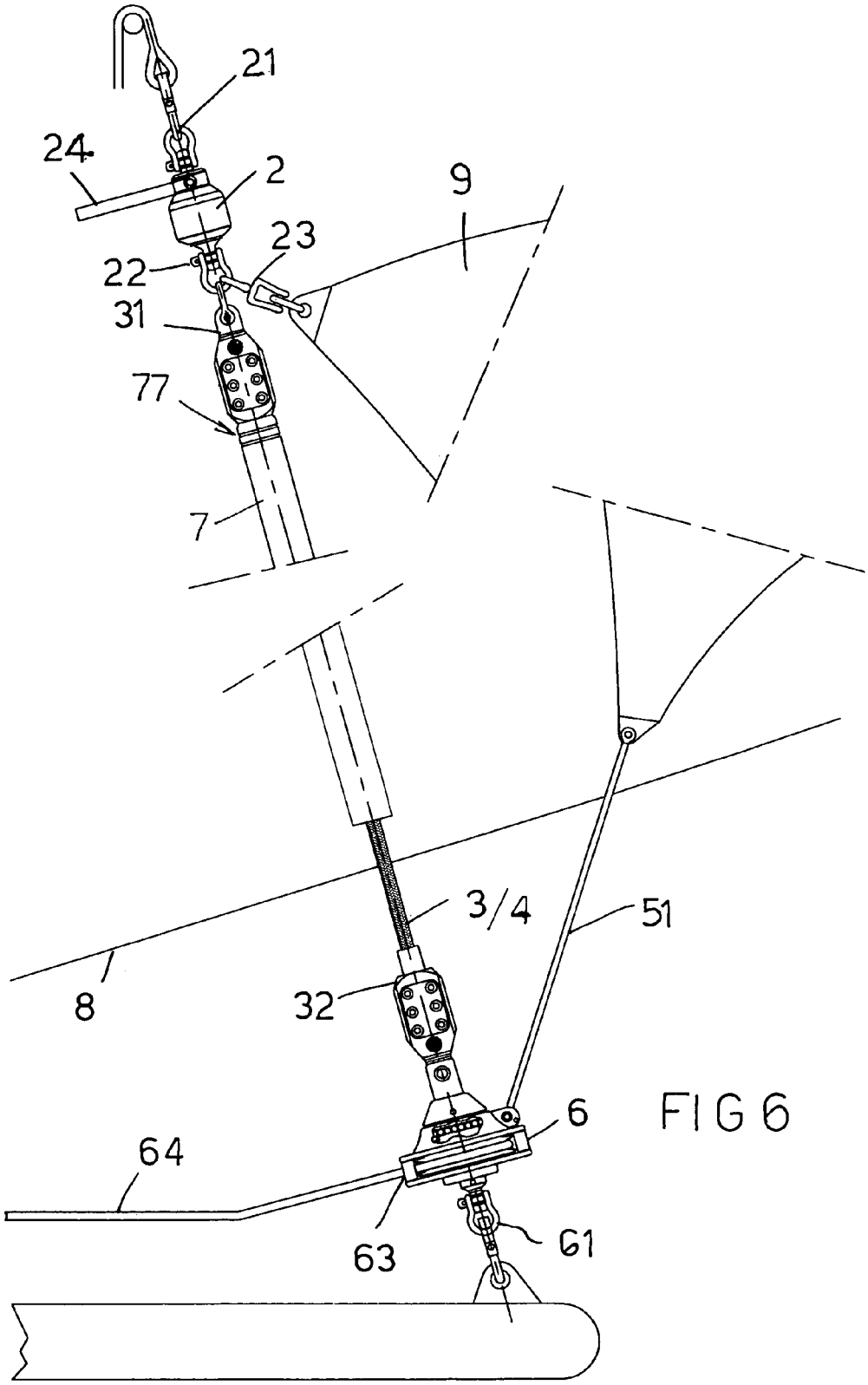
FIG. 6 is a further detail view illustrating on an enlarged scale, a further detail of the subject furling device.

With reference to the number references of the above mentioned figures, the sail furling/unfurling device according to the present invention, which has been generally indicated by the reference number 1 (FIG. 5), comprises an outer foil 4, wound about an inner foil or stay 3, for transmitting a furling torque necessary for furling a sail 9, a further sheath profiled element 7 being moreover arranged outside of the foils 3 and 4.

More specifically, the inner foil or stay 3 comprises, for example, a sheet or rope and the outer foil 4 comprises, for example, a flexible strip wound on the sheet and made rigid with the latter.

Figure 21:
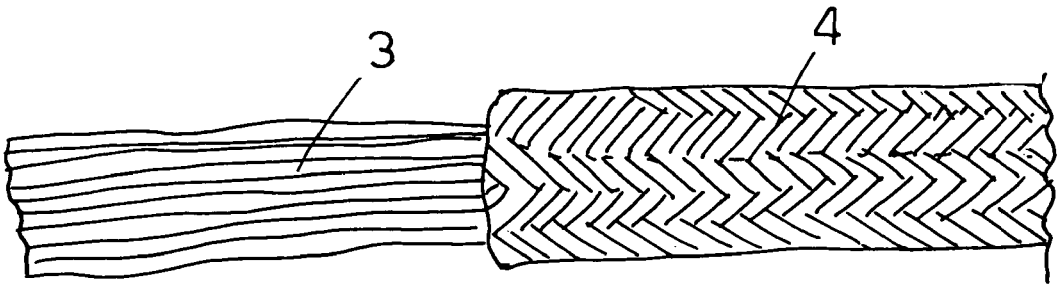
FIG. 21 shows the furling device comprising an outer foil wound about and rigid with an inner foil or stay designed for transmitting the furling torque necessary for furling a sail.
Figure 22:
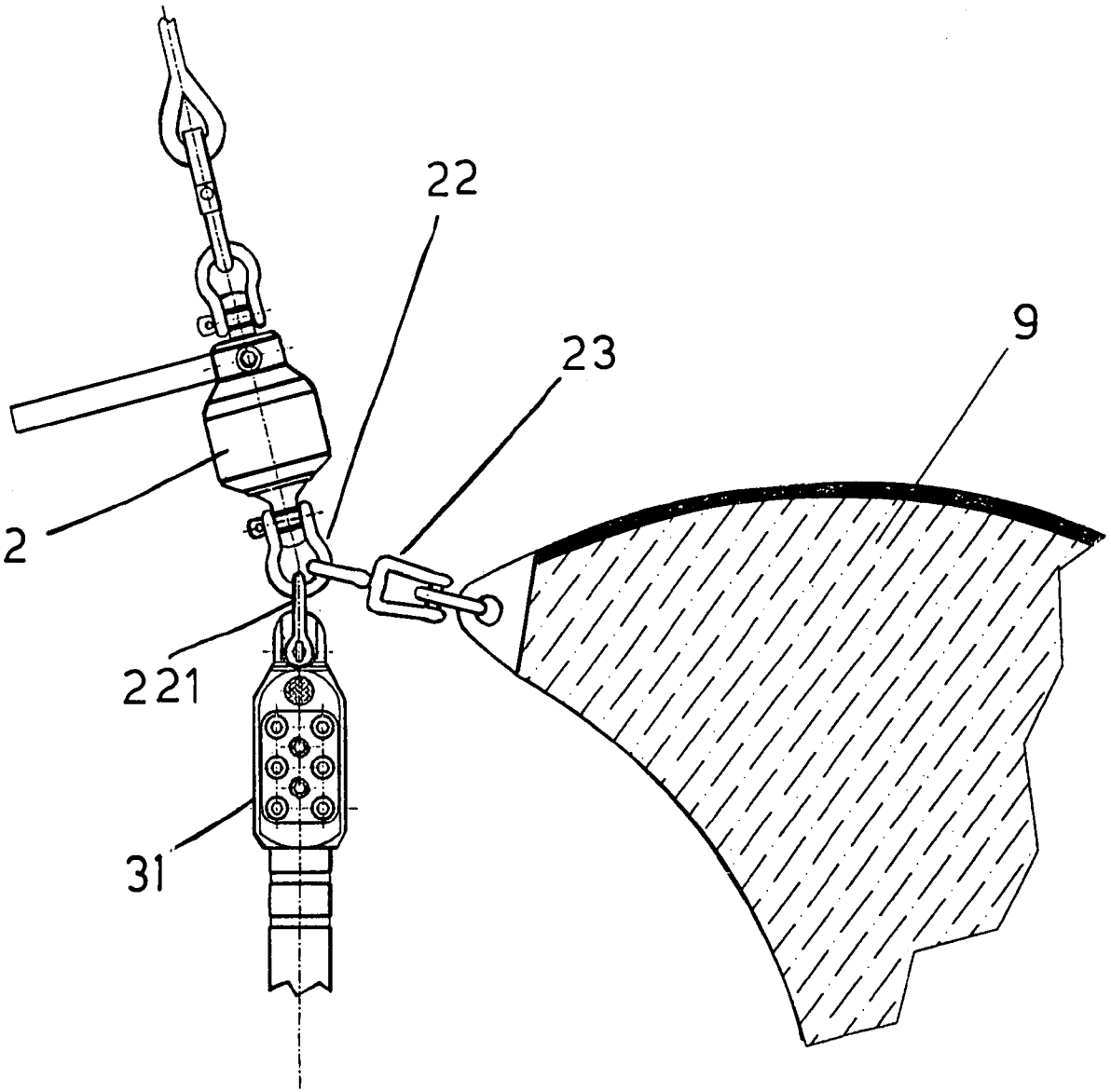
FIG. 22 shows the asymmetric sail top swivel shackle 23 and sail 9, and further shows an inner foil or stay attachment terminal, a halyard swivel, an asymmetric sail swivel shackle and two fastening elements therefor.
Figure 23:
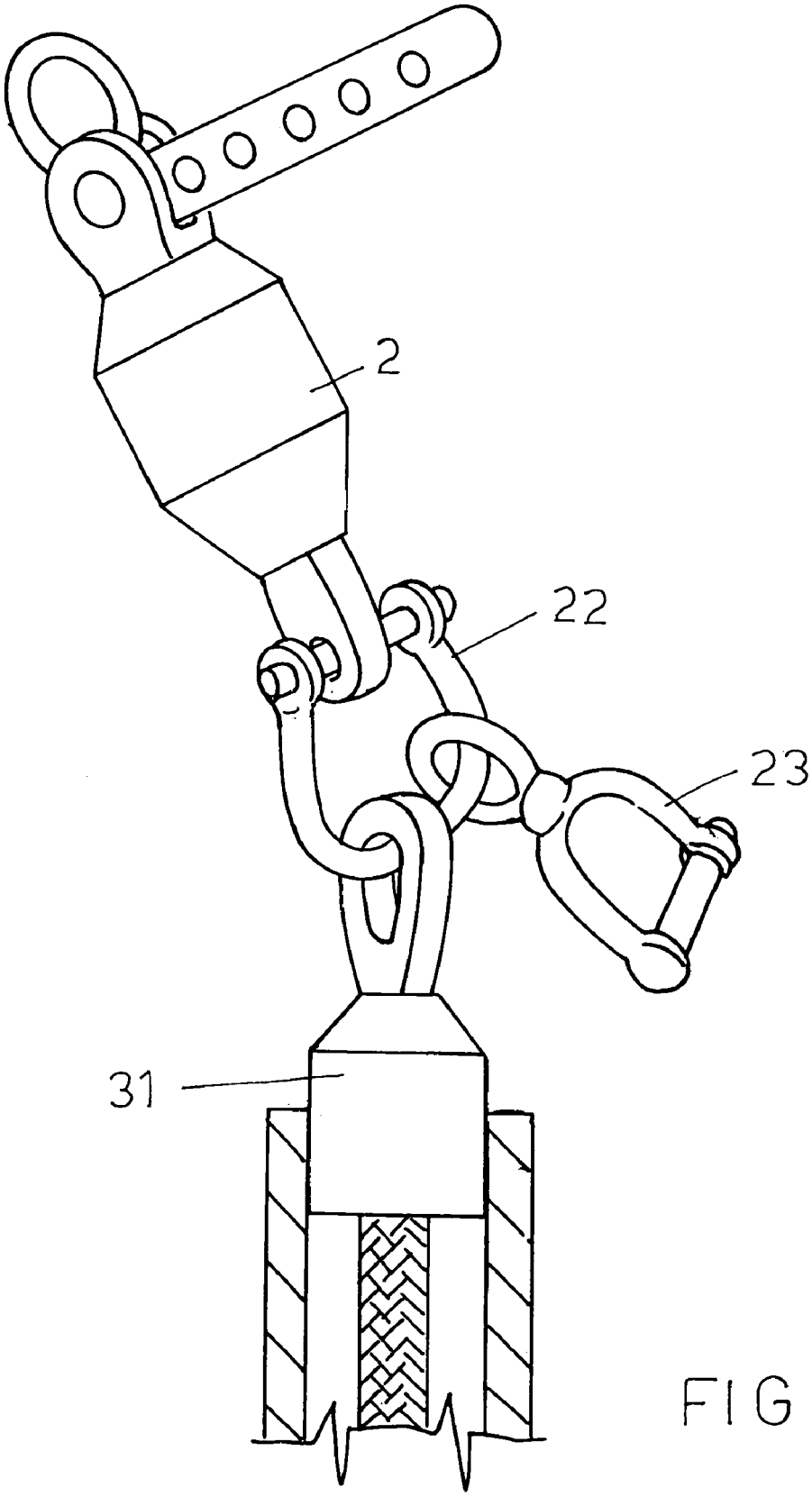
FIG. 23 illustrates the detail shown in FIG. 22 and further illustrates an inner foil or stay attachment terminal, a halyard swivel, an asymmetric sail top swivel shackle and a single fastening element between the halyard swivel, the profiled element terminal and the asymmetric sail top swivel shackle.
Figure 24:
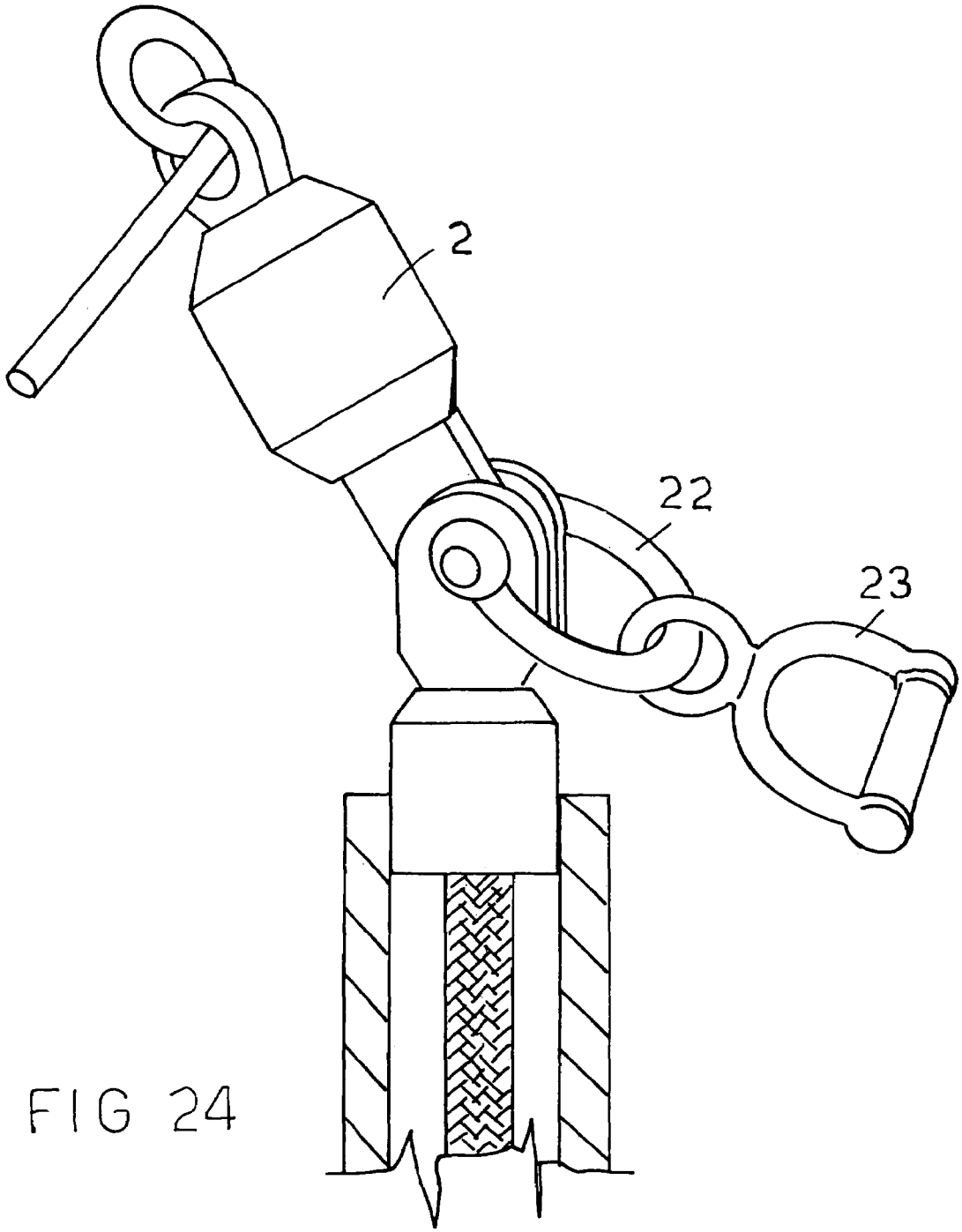
FIG. 24 shows a modified embodiment of FIG. 22, in which the halyard swivel is directly coupled to the foil or stay terminal and a fastening member connects the sail top swivel shackle.
Figure 25:
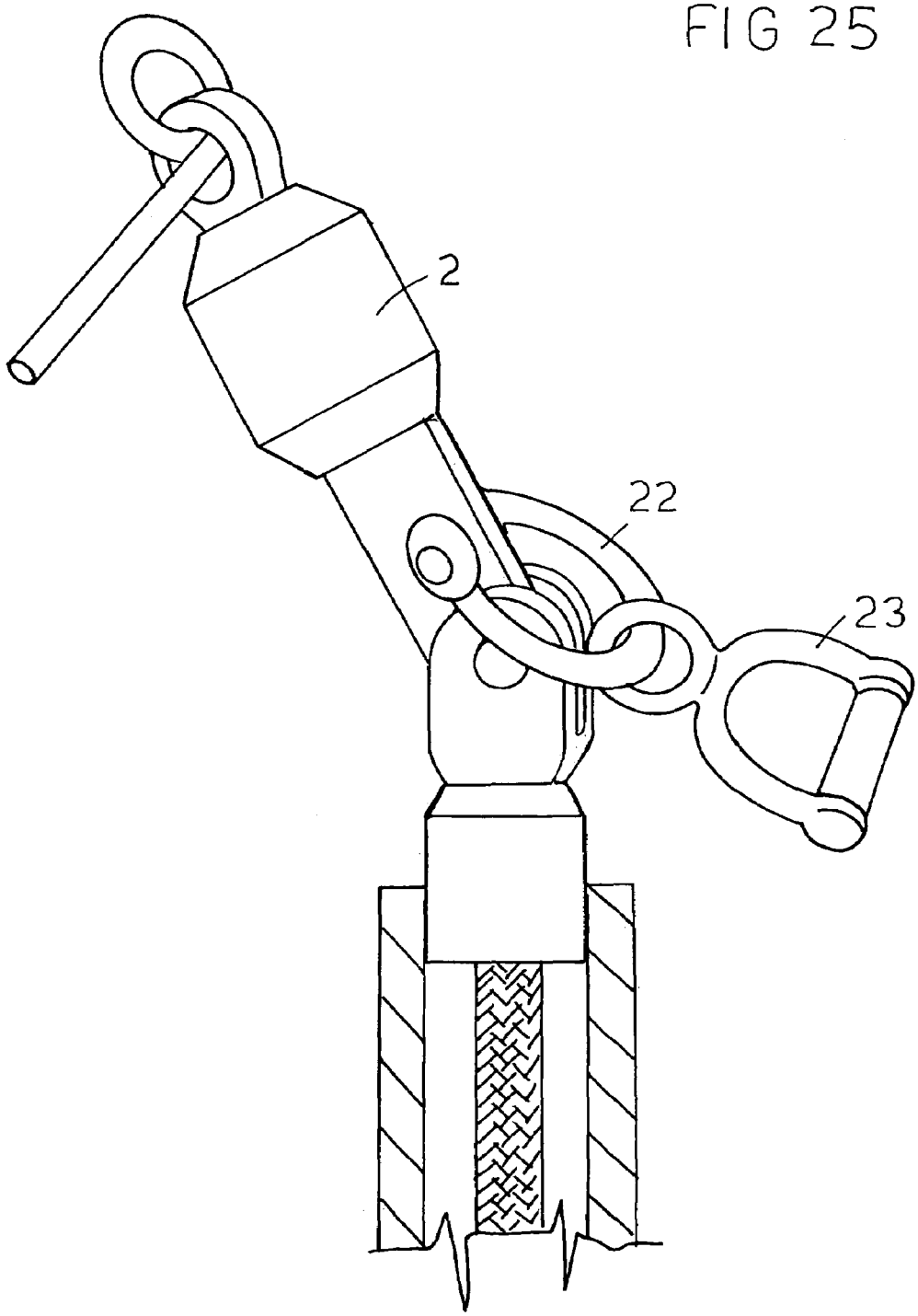
FIG. 25 shows a modified embodiment of FIG. 23, in which the sail top swivel shackle is directly coupled to the halyard swivel by a fastening member.

According to a modified embodiment (see FIG. 21) the foil or stay 3 comprises, for example, high strength unidirectional fibers, and the outer foil 4 comprises, for example, crossed fibers.

The outer foil 4 is made rigid with the inner foil or stay 3 for example by a thermal processing.

The crossed fibers of the foil 4, as they are shrunk in said thermal processing, will clamp the foil or stay 3 thereby forming a rigid or single-piece construction.

The sheath profiled element 7 is constituted, for example, by a flexible strip, having a suitable size and a tubular configuration, the thickness of which is increased by a plastic film.

Figure 20:
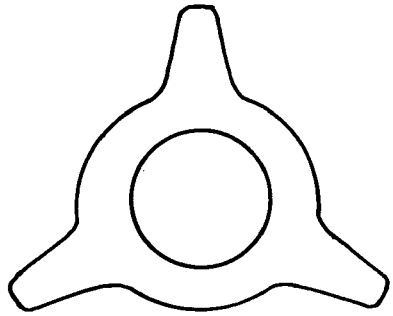
FIG. 20 shows a tubular sheath profiled element including projecting or boss portions.

According to a further modified embodiment (see FIG. 20), the sheath profiled element 7 comprises, for example, foamed rubber, as profiled or contoured in a particular manner, having a suitable size and tubular shape, with furling diameter increasing projecting or boss portions, which provide a satisfactory mechanical resistance and less weight.

The furling device 1 comprises, as essential components thereof, a halyard swivel 2, having a halyard attachment terminal or fitting 21, two inner foil or stay attachment terminals or fittings 22 and 221, and a sail top swivel shackle 23 and an anti-rotation rod 24.

The anti-rotation rod 24 prevents the torque provided by the furling system from twisting the halyard.

The inner foil or stay 3 rigid with the outer foil 4 is connected to the halyard swivel 2 by a terminal element or fitting 31 and to a furling drum 6, through a terminal element of fitting 32.

The sheath profiled element 7 is connected to the inner foil or stay 3, which is rigid with the outer foil 4 only at the head or tip point 77.

The furling drum 6 comprises an attachment terminal 61 for coupling to the boat deck (not shown), and comprises moreover an endless line kit 63, with a related top circuit 64, for furling or unfurling the sail.

On said furling drum 6 is mounted a rotary base 5, including the asymmetric sail shackle and halyard strop assembly 51.

Said endless line 64 is coupled to the cockpit by a suitably coupling system, of a per se known type.

The operating principle of the system is based, from a dynamic standpoint, on furling the sail starting from the head portion thereof, due to the torsion provided on the halyard swivel 2 by the inner foil or stay 3 rigid with the outer foil 4 providing the sail torsion torque.

Said outer foil 4, in particular, is driven by the furling drum 6, in turn driven from the cockpit through the endless line 64, whereas the sail swivel tack 51 does not follow the furling movement, since it is rigid with the rotary base 5.

The sail is wound on the sheath profiled element 7 as entrained or driven by the swivel shackle 23, the sheath 7 being driven by the rudderpost point 77.

The furling operation, in particular, proceeds from the top toward the bottom: at first the sail head portion is furled and then the central portion up to entrain the swivel tack 51 of the sail bottom.

The portion of the sail coupled to the driving foil or sheet 8 is wound or furled by the furling system.

The operation principle of the system, during an unfurling operation is based, from a dynamic standpoint, on the sail spreading action provided by pulling the driving sheet 8.

The inner foil or stay 3, rigid with the outer foil 4, while assuring a necessary flexibility during the sail storing operation, is adapted to transmit the necessary torque to the halyard swivel 2, with a few revolution "delay".

The sheath profiled element 7 is adapted to furl, without deforming or tearing, the sail, both during the furling operation and during the bag storing step.

The size of the sheath profiled element 7 is so designed as to provide, during the sail furling operation, the necessary torque, by removing the drive sheet 8 from the rotary center, on which said sail is furled.

The furling device 1 comprises, as stated, an inner foil or stay 3 and an outer foil 4, including, for example, a flexible strip, furled on the sheet and made rigid therewith.

Figure 1:
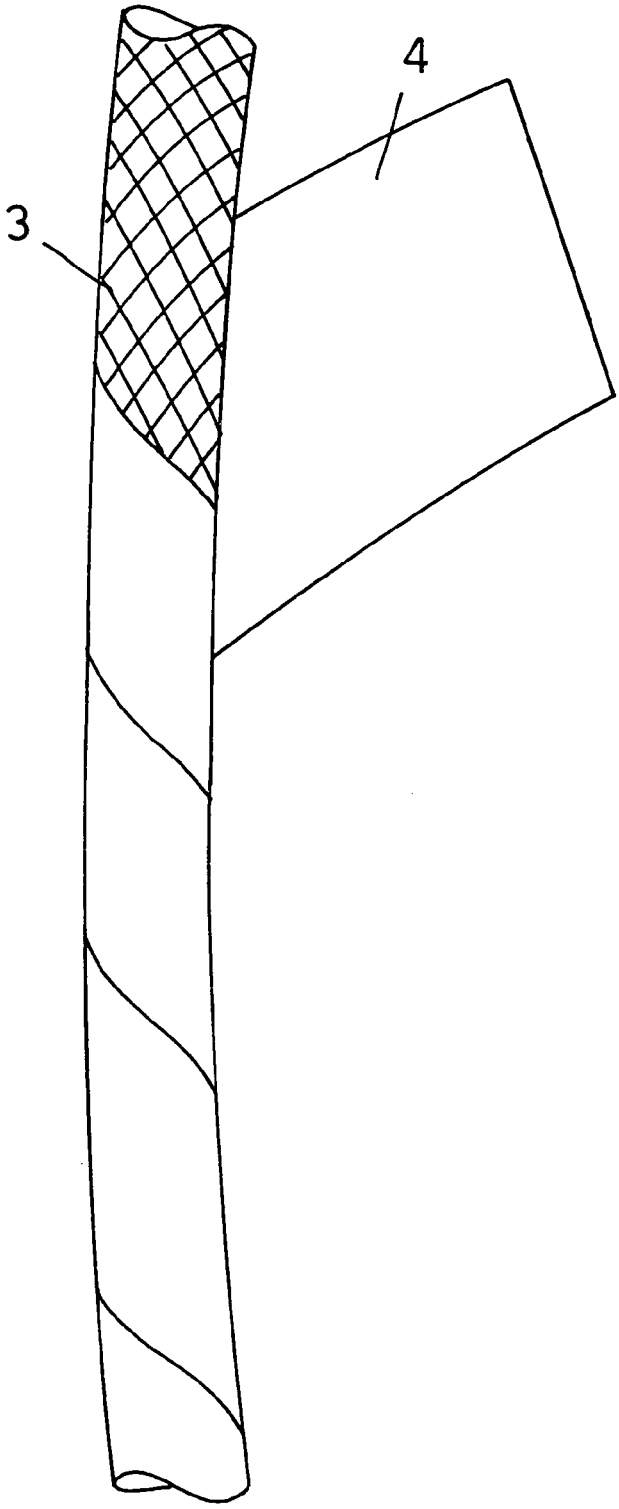
FIG. 1 is a view of a detail of the sail furling device according to the present invention, being shown in a condition thereof in which the outer foil is partially wound or furled about the inner foil or stay and with a detached flap.
Figure 2:
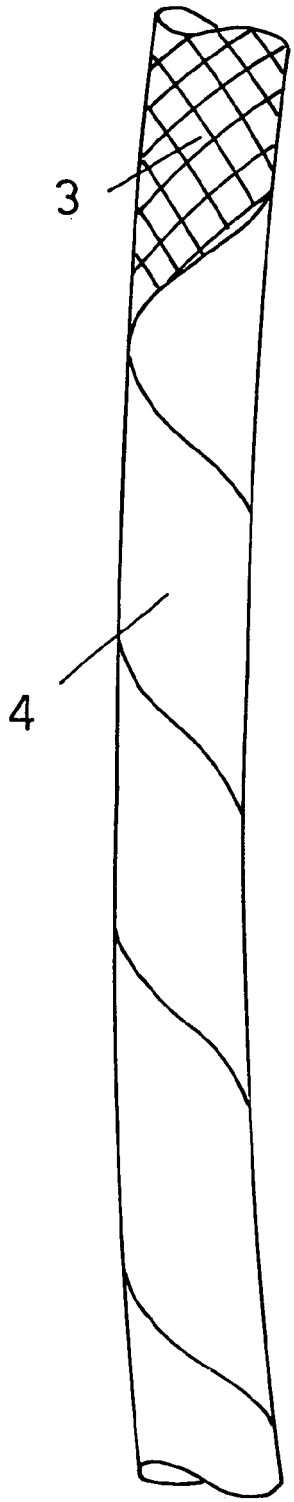
FIG. 2 is a view of a detail of the furling device according to the invention.
Figure 3:
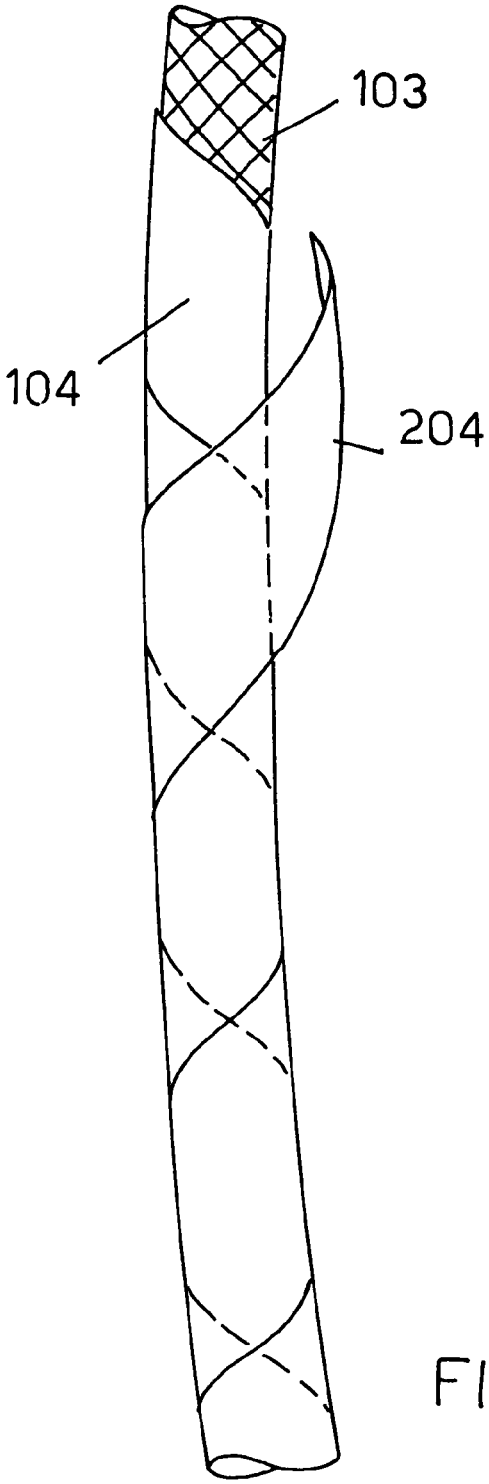
FIG. 3 is a view of a detail similar to the preceding figures, showing a device including two crossed outer foils.
Figure 4:
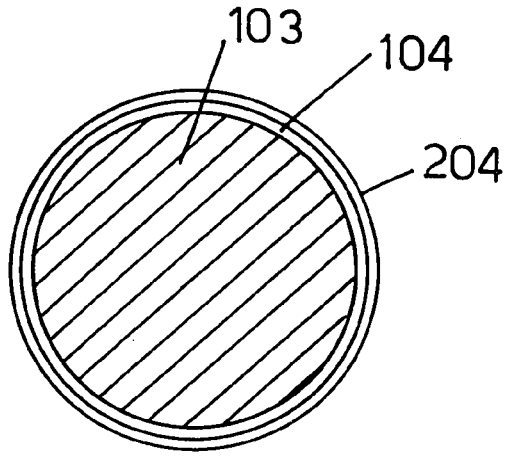
FIG. 4 is a cross-sectional view illustrating a detail of the furling device according to the invention.

FIGS. 3 and 4 show a modified embodiment.

The outer foil is herein constituted by two crossed orders of foils 104 and 204 and is rigid with an inner foil or stay 103.

The number and arrangement of outer foils will depend on the flexibility degree and, in general, on the required characteristics, the type of sails to be used and boat type.

The sail top swivel shackle 23, sail 9 and attachment terminals or fittings 22 and 221 can assume different configurations, of which FIGS. 22, 23, 24 and 25 show an example.

Figure 7:
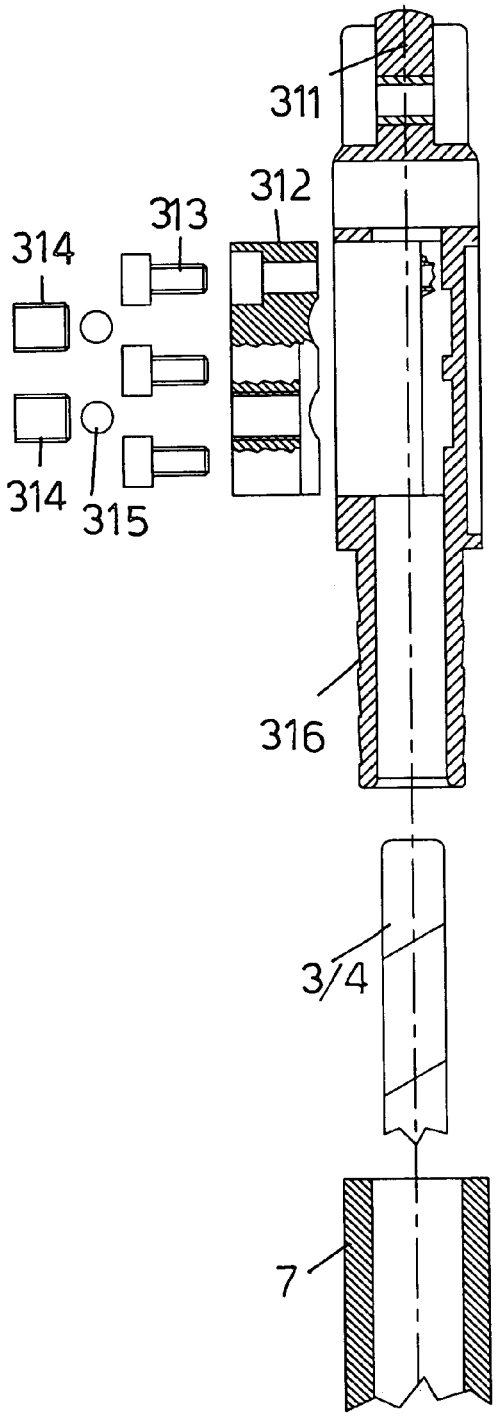
FIG. 7 is a cross-sectional view of an exploded detail of a clamping element.
Figure 8:
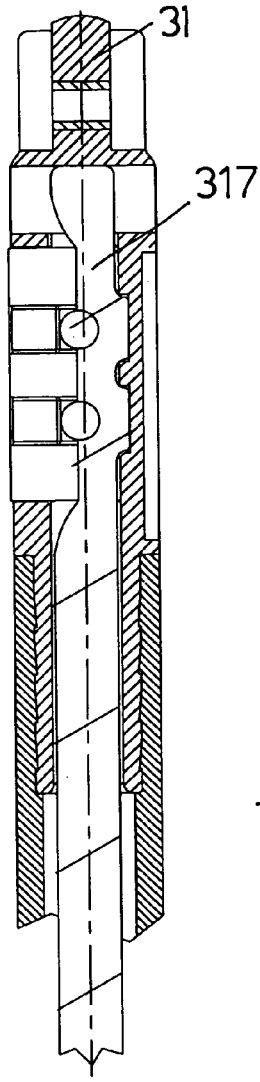
FIG. 8 is a further cross-sectional view of a further detail of the clamping element shown in FIG. 7.
Figure 9:
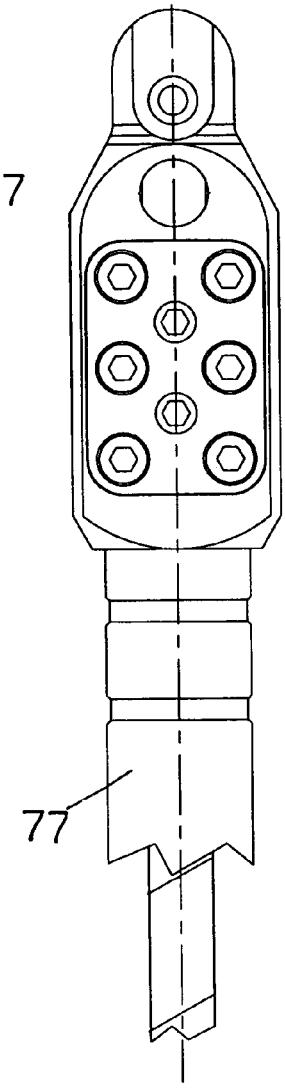
FIG. 9 is a view of a front detail of the clamping element shown in FIG. 8.

FIGS. 7-9 show in a detailed manner a construction of the clamping terminal 31, comprising a base or bottom 311, a locking flange 312, locking screws 313, dowels 314 and related balls 315, and a collar 316, for housing therein the sheath 7 at the point 77.

Said figures show moreover the assembling of the sheath 7 on the clamp 31 and the locking of the foils 3 and 4 on said clamp 31.

Further details of the locking element 317 which receives a torsion torque from the foils 3 and 4 are moreover shown.

The bottom clamp 32 is substantially identical to the above disclosed clamp 31 and is also constituted by a base or bottom, a locking flange, locking screws, ball-dowel assemblies, analogous to those shown in FIGS. 7-9.

Figure 11:
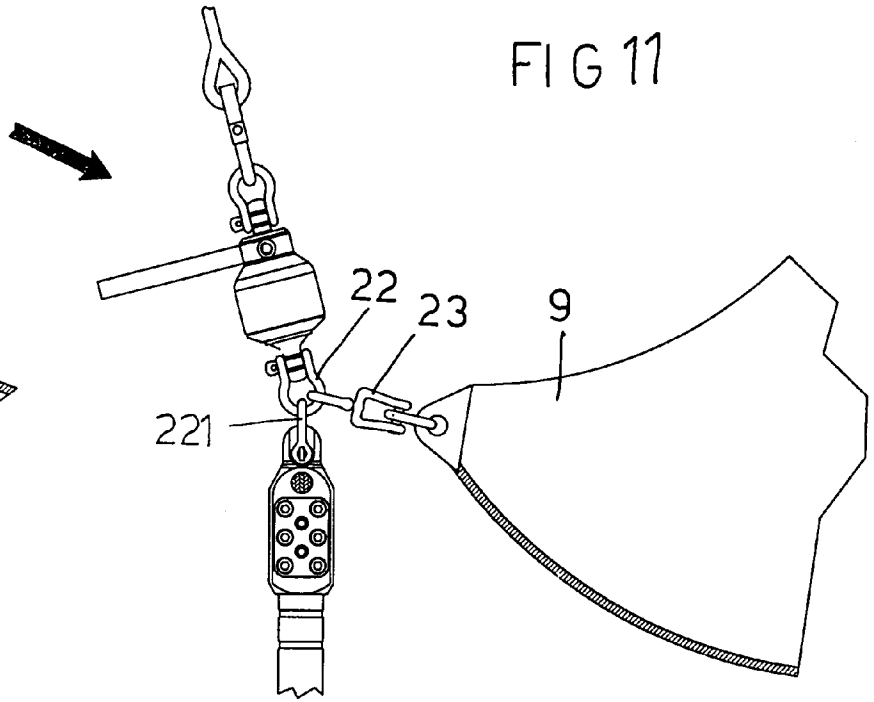
FIGS. 10 and 11 are schematic views illustrating an asymmetric swivel shackle of the sail top, the sail and attachment terminal, during a sail tack changing operation, as aided by said swivel shackle of the sail top.
Figure 10:
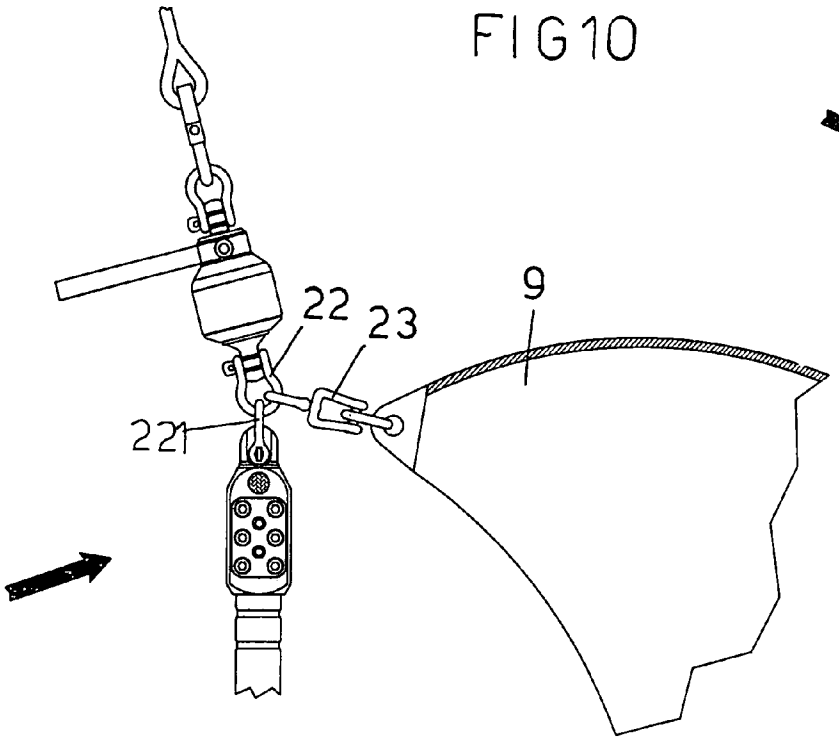

FIGS. 10-11 schematically show the asymmetric sail top swivel shackle 23, sail 9 and attachment terminal or fitting 22.

In particular, said figures show that the sail pack change is aided by said sail top swivel shackle 23.

Figure 13:
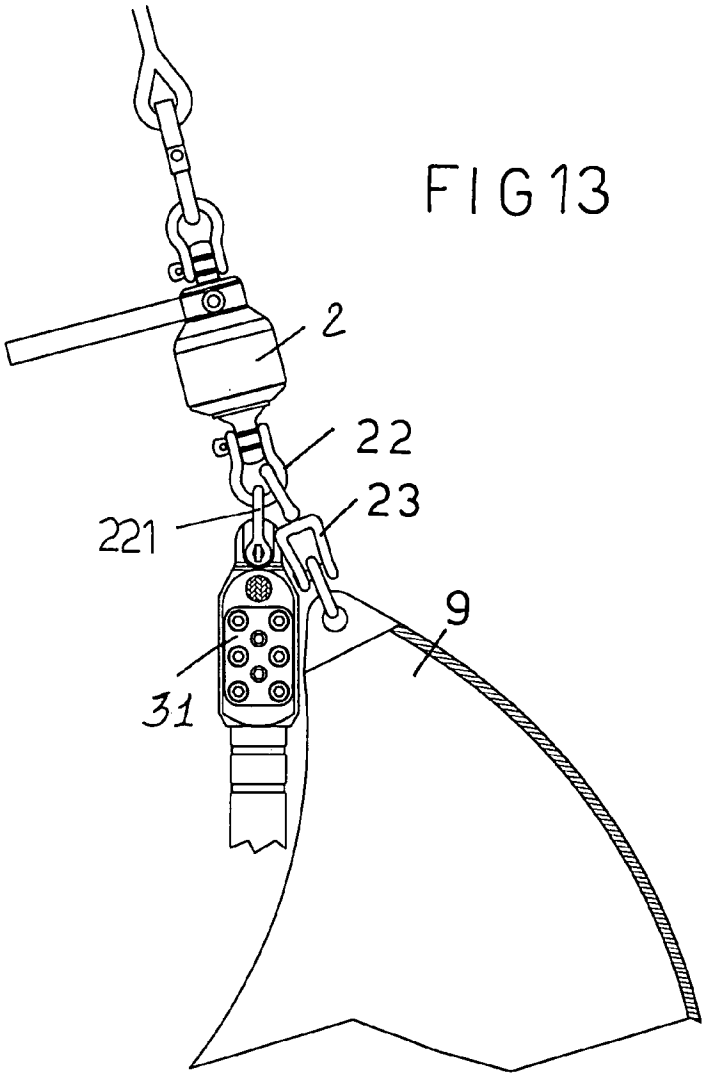
FIGS. 12 and 13 are further schematic views illustrating the asymmetric sail swivel shackle, the sail and attachment terminal, during a furling operation.
Figure 12:
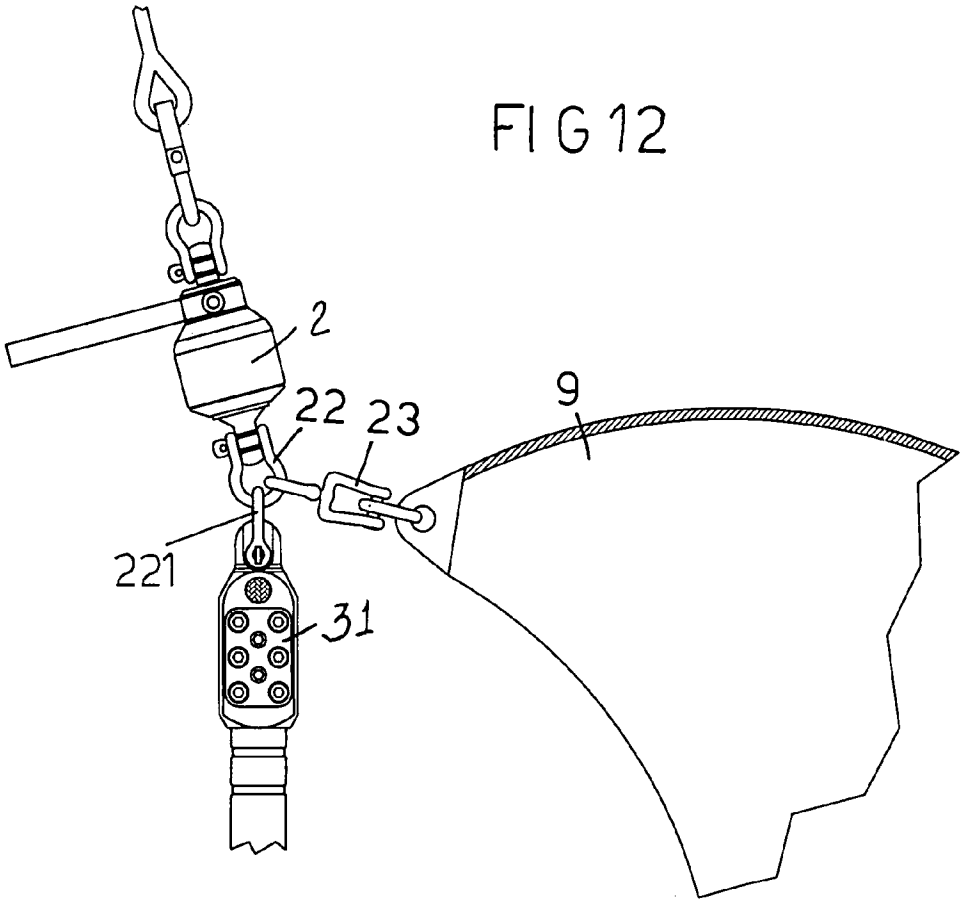

FIGS. 12-13 show that, during the furling step, the resisting torque is minimum, thereby greatly facilitating the operation.

Figure 15:
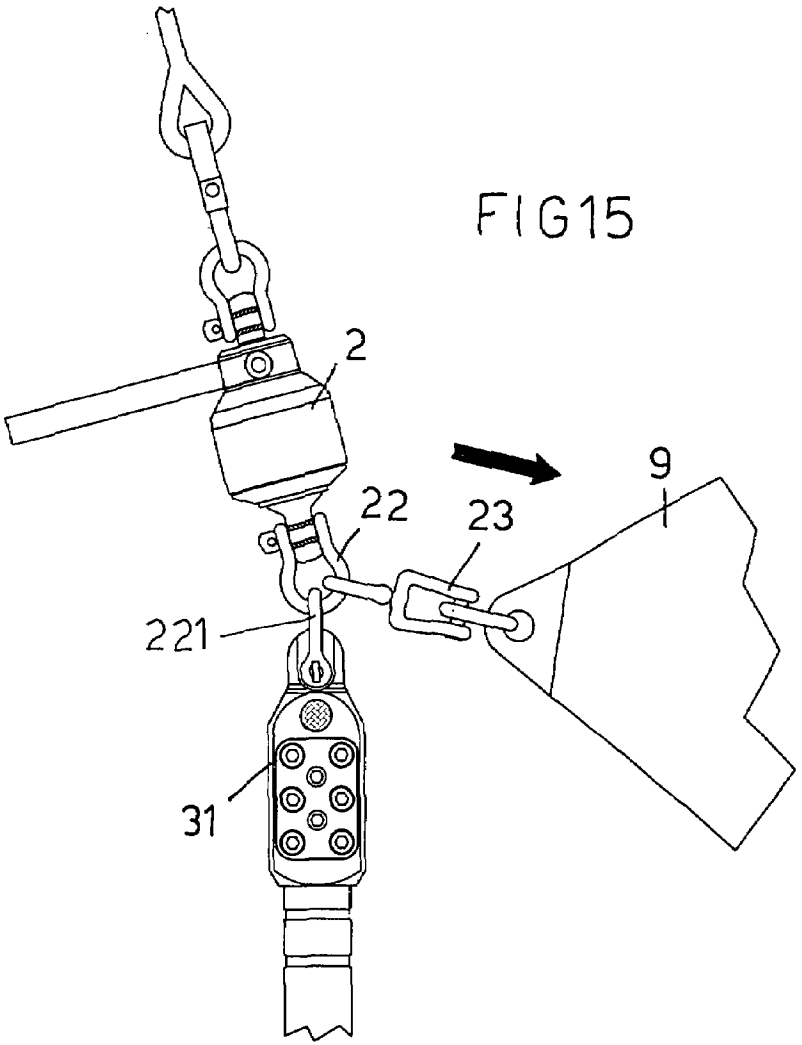
FIGS. 14 and 15 are further schematic views illustrating the asymmetric sail swivel shackle, the sail, attachment terminal, halyard swivel and clamping terminal, in two operating steps.
Figure 14:
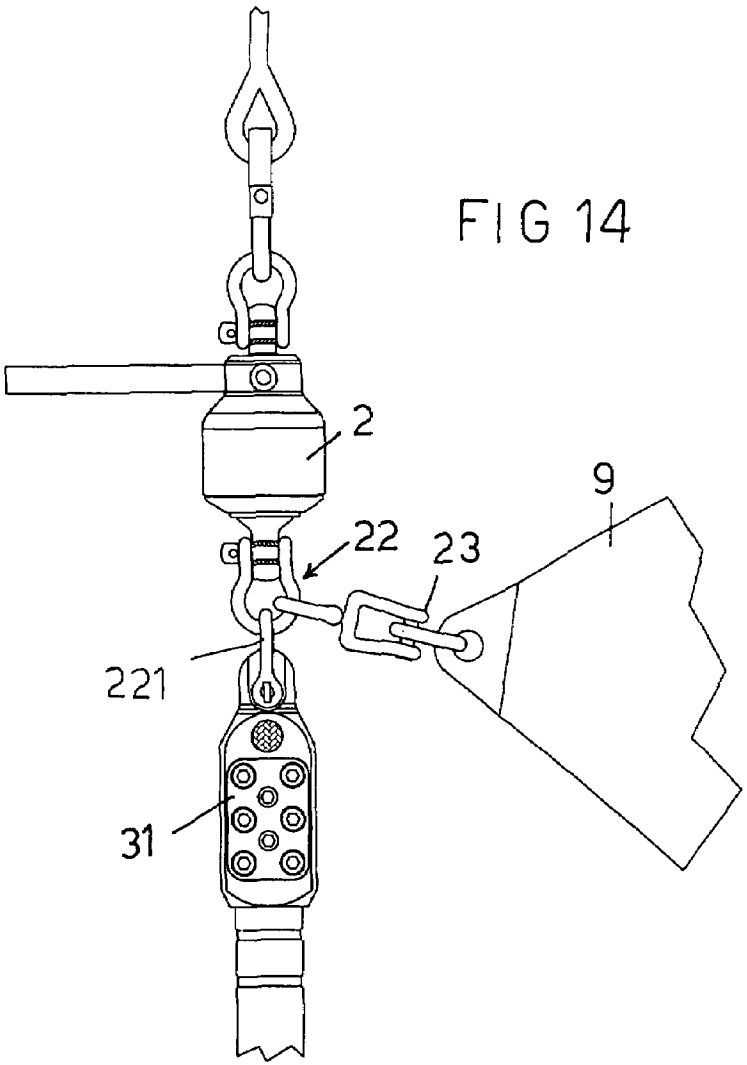

FIGS. 14-15 show that, in the working step, i.e. under the pulling force provided by the sail 9 through the sail top swivel shackle 23 on the attachment terminal 22, the assembling system herein disclosed allows the components of the halyard swivel 2 and clamp 31 to operate on an optimal axis, thereby providing a maximum efficiency and a minimum wear.

Figure 16:
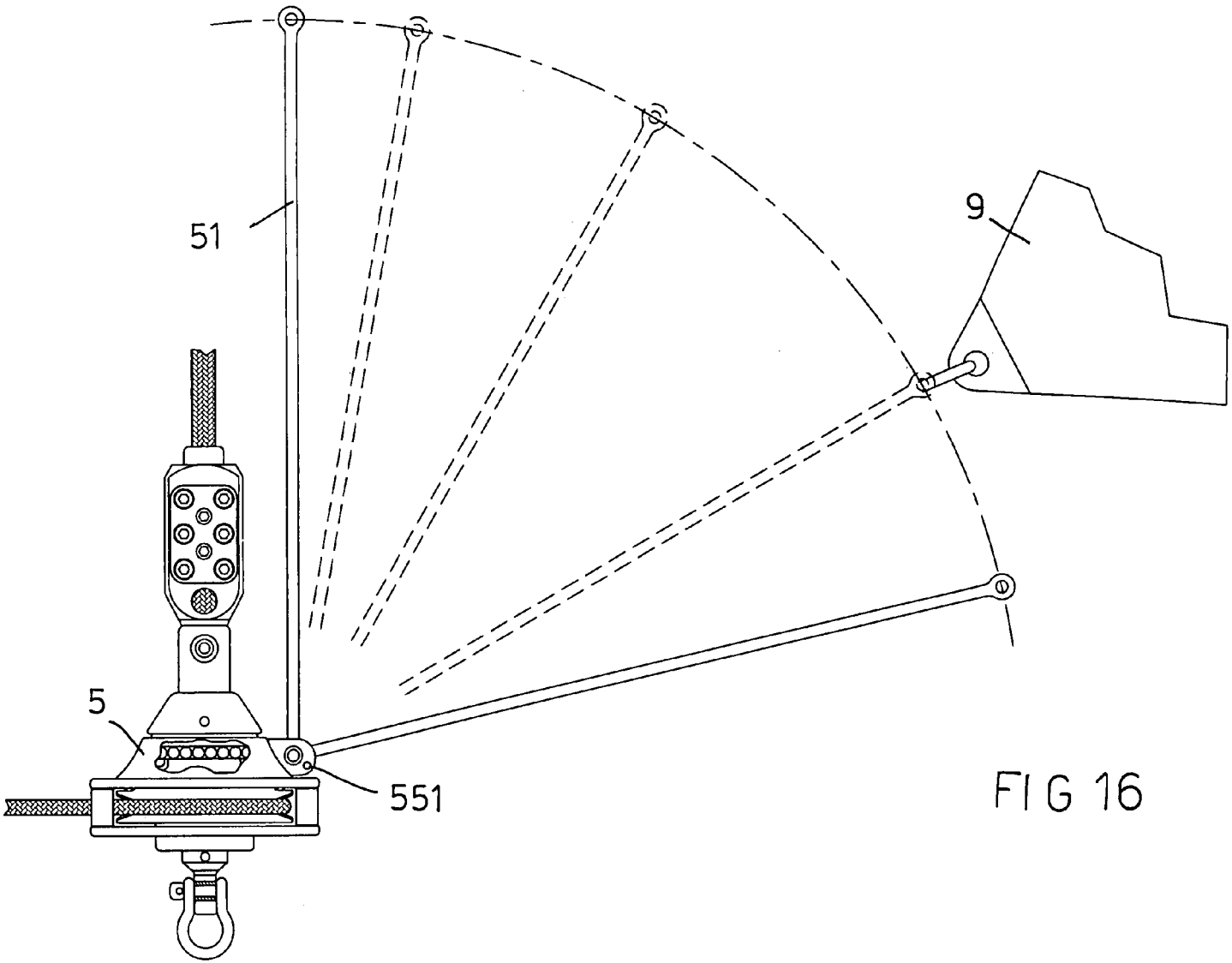
FIG. 16 schematically illustrates the movement of the semirigid rod of the swivel tack.

FIG. 16 schematically shows that the semi-rigid rod of the swivel tack 51 cannot be lowered under the position schematically indicated in this figure, since the pin element 551 cannot be lowered under the position schematically indicated in this figure, since the pin element 511 provides a detent or stop function.

FIG. 16 shows, in a furling operation and in absence of wind, that the system prevents the sail 9 from falling downward under the rotary plane of the furling drum 6.

The semi-rigid rod of the swivel tack 51 is so designed as to increase the resistance to the furling torque, preventing the sail from being furled at the bottom portion thereof, before having completed the furling of the sail head and middle parts.

This feature will provide a proper operation, under any operating conditions.

Figure 17:
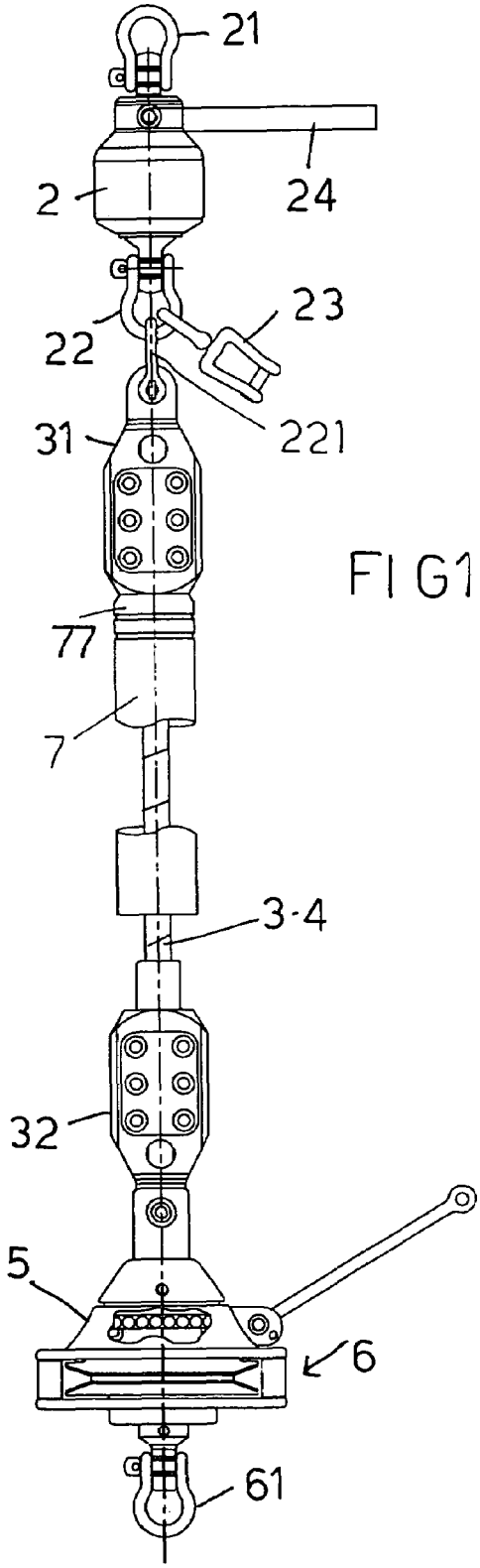
FIGS. 17 and 18 show an use procedure for using the clamping terminal for installing the equipment or device onboard to lock the foil, after having set the assembling measurement.
Figure 18:
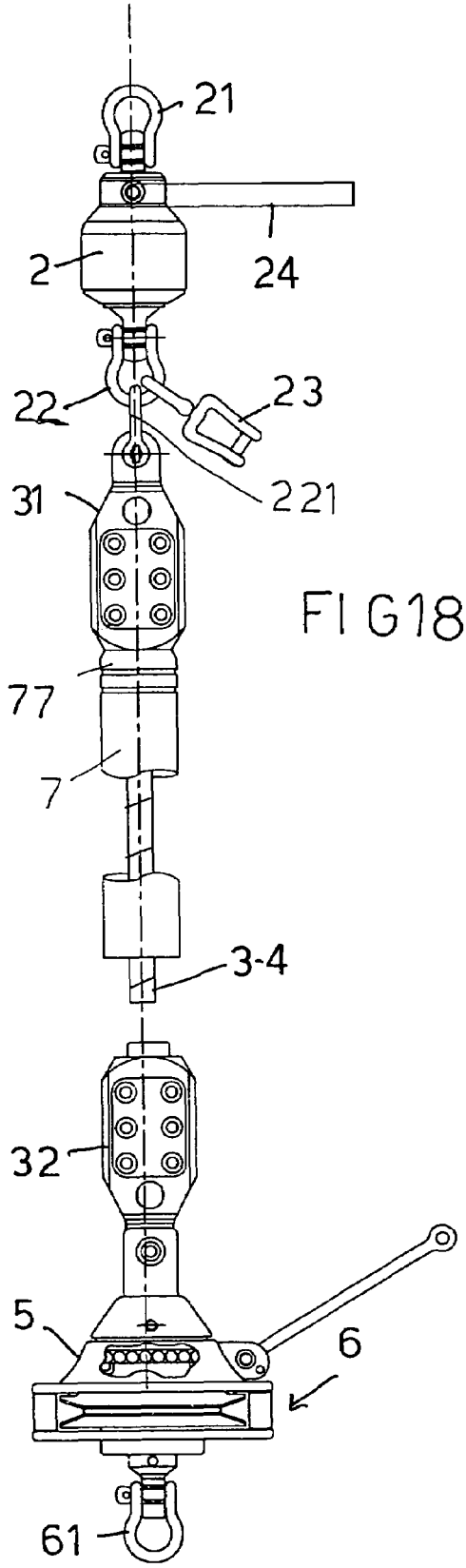
Figure 19:
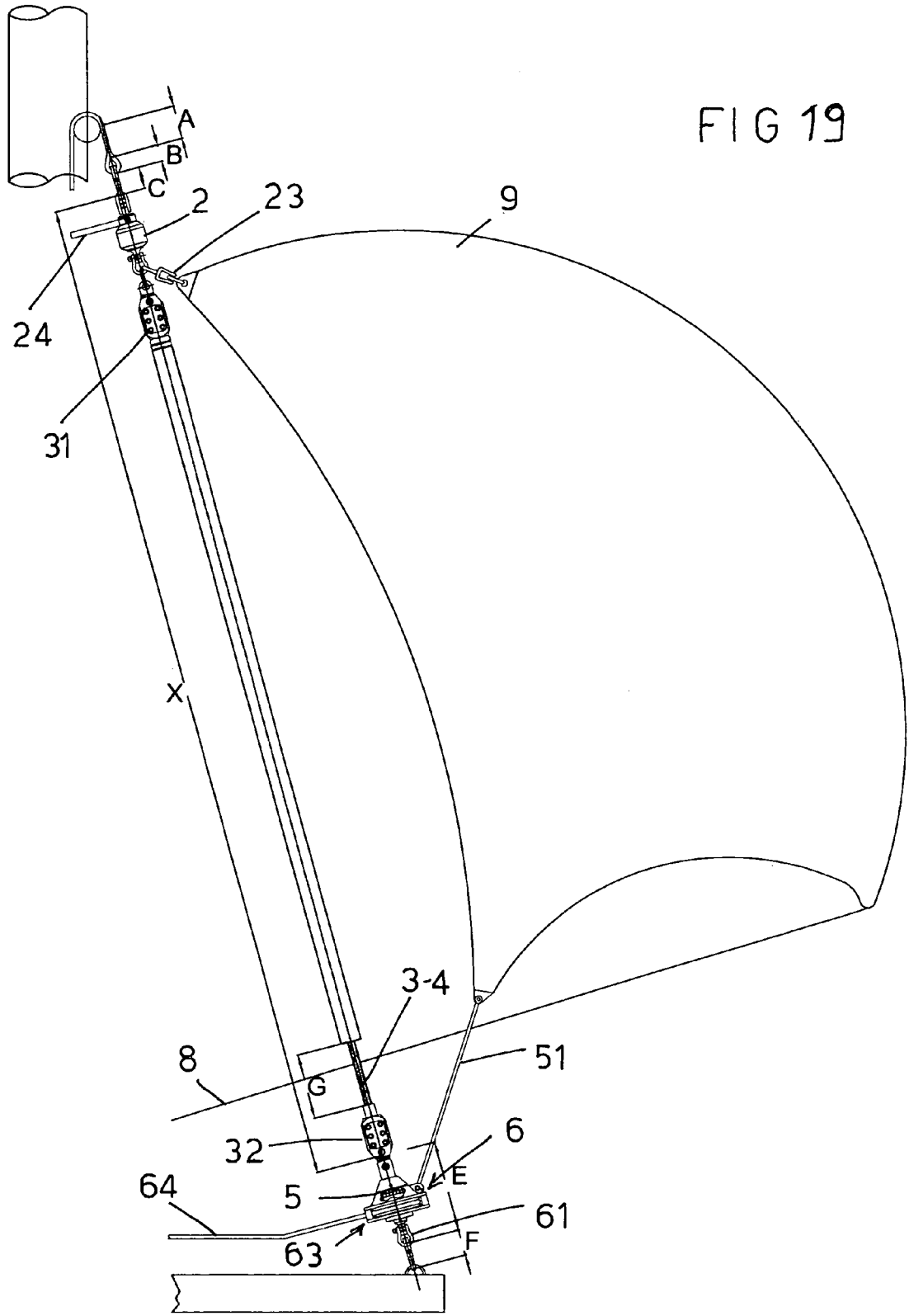
FIG. 19 is an enlarged view of the device according to the invention.

FIGS. 17-19 show that the clamp or fitting 32 is used in installing the device onboard, to lock the foil or stay 3 and foil 4 after having set the assembling measurement.

The procedure schematically shown in FIGS. 17-19 provides to perform the following operating steps:

measuring the distance between the swivel tack of the furling system and the rudderpost point, and calculating a target or desired amount by subtracting the amounts A, B, C, E, F;

transferring the useful measurement "X" on the foils 3 and 4;

modifying the length of the foils 3 and 4 to the useful amount and modifying the length of the sheath 7 to the useful amount from which the amount "G" has been subtracted.

It has been practically found that the invention fully achieves the intended aim and objects.

In fact, the invention provides a furling device allowing to furl and unfurl downwind sails, asymmetrical spinnakers or the like such as gennakers or MPS, of standard construction.

The device according to the invention can be easily used and allows to hoist and lower the sail with very simplified operations, for a cruiser sailing with a short-hand crew.

Moreover the device according to the invention greatly improves crew safety in handling large size downwind sails, such as asymmetric spinnakers or the like, i.e. gennakers or MPS.

Yet another important advantage of the device according to the invention, deriving from its simplified maneuvering operations and increased crew safety, is that it allows a cruiser sailing with a short-hand crew to use much more frequently downwind sails.

In practicing the invention, the materials used, as well as the contingent size and shapes, can be any, according to requirements ant the status of the art.

The invention claimed is:

1. A furling device for furling sails on a sail boat, comprising an outer foil assembly including two crossed orders of outer foils wound about and made rigid with an inner foil adapted to transmit a sail furling torque to furl said sail on a sheath profiled element, said sheath profiled element comprising a flexible tubular strip having a strip portion with an increased thickness, said furling device being applied to a furling system comprising a halyard swivel having a halyard attachment terminal, an inner foil attachment terminal, an asymmetric sail swivel shackle and an anti-rotation rod preventing said furling system torque from twisting said sail boat halyard, said outer foil assembly being made rigid with said inner foil and being coupled to said halyard swivel by a coupling terminal and a furling drum, through a further connecting terminal, said sheath profiled element being coupled to said outer foil assembly only at a head point, said furling drum comprising an attachment terminal for coupling to a deck onboard and a continuous furling system including an endless line kit, a rotary base including an asymmetric sail swivel shackle, wherein said furling device further comprises a terminal foil assembly locking clamp including a base, a locking flange, locking screws, ball-dowel assemblies, and a collar for housing said sheath profiled element.

2. A furling device according to claim 1, wherein said inner foil comprises an unidirectional fiber assembly, and said outer foil assembly comprises a crossed-fiber assembly, said crossed-fiber assembly including crossed thermally shrinkable fibers which can be shrunk by a thermal process to clamp said inner foil thereby forming an integral outer and inner foil construction.

3. A furling device according to claim 2, wherein said increased thickness of said tubular strip portion is provided by applying to said flexible tubular strip a tubular profiled element including diameter increasing furling projections.

4. A furling device according to claim 1, wherein, with said sail providing a furling resistance force on said attachment terminal through said swivel shackle, said swivel shackle and attachment terminal are arranged at a minimum spacing and radius from their rotary axis to generate a minimum resistance torque.

5. A furling device according to claim 1, wherein said device further comprises a detent pin for preventing a semi-rigid tack rod from being lowered under a set position.

6. A furling device according to claim 1, wherein, in a sail furling step and in absence of wind, said sail is always held above a rotary plane of said furling drum.

7. A method for assembling on board of a sail boat a furling device according to claim 1, wherein said method comprises the steps of:

measuring a value of a distance between a swivel tack of said furling device and a rudderpost point;

calculating a target distance value;

transferring said target distance value to said foil assembly; and modifying a length of said foil assembly to a foil assembly set length and modifying a length of said sheath to a sheath set length.

* * * * *